US007203439B2

(12) United States Patent
Sone et al.

(10) Patent No.: US 7,203,439 B2
(45) Date of Patent: Apr. 10, 2007

(54) FIXING DEVICE OF IMAGE FORMING APPARATUS WITH NON-CONTACT TEMPERATURE SENSOR

(75) Inventors: Toshihiro Sone, Kanagawa-ken (JP); Osamu Takagi, Tokyo (JP); Satoshi Kinouchi, Tokyo (JP); Yoshinori Tsueda, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 85 days.

(21) Appl. No.: 11/080,943

(22) Filed: Mar. 16, 2005

(65) Prior Publication Data

US 2006/0210330 A1 Sep. 21, 2006

(51) Int. Cl.
*G03G 15/20* (2006.01)

(52) U.S. Cl. ..... 399/69; 399/122

(58) Field of Classification Search ..... None
See application file for complete search history.

(56) References Cited

U.S. PATENT DOCUMENTS 6,861,630 B2 3/2005 Kinouchi et al.
6,871,041 B2 3/2005 Takagi et al.
2003/0227533 A1* 12/2003 Yokoi ..... 347/156
2004/0265021 A1 12/2004 Kinouchi et al.
2005/0008413 A1 1/2005 Takagi et al.
2005/0053390 A1* 3/2005 Suzuki et al. ..... 399/69

FOREIGN PATENT DOCUMENTS

JP 2002-296963 A 10/2002
JP 2004-013024 A 1/2004

OTHER PUBLICATIONS

U.S. Appl. No. 11/082,242, filed Mar. 17, 2005, Sone et al.
U.S. Appl. No. 11/082,198, filed Mar. 17, 2005, Sone et al.
U.S. Appl. No. 11/080,942, filed Mar. 16, 2005, Kinouchi et al.
U.S. Appl. No. 11/080,909, filed Mar. 16, 2005, Kinouchi et al.
U.S. Appl. No. 11/078,421, filed Mar. 14, 2005, Takagi et al.
U.S. Appl. No. 11/078,725, filed Mar. 14, 2005, Takagi et al.
U.S. Appl. No. 11/080,833, filed Mar. 16, 2005, Tsueda et al.
U.S. Appl. No. 11/078,726, filed Mar. 14, 2005, Tsueda et al.

(Continued)

*Primary Examiner*—Quana Grainger
(74) *Attorney, Agent, or Firm*—Foley & Lardner LLP

(57) ABSTRACT

A fixing apparatus of an image forming apparatus of the present invention strikes a support plate having an infrared temperature sensor against a roller shaft of a heat roller, thereby, regardless of the part accuracy, keeps a gap between the heat roller and the infrared temperature sensor constant. By improvement of the temperature detection accuracy of the infrared temperature sensor, the temperature control of the heat roller is improved and toner images can be fixed always at a fixed temperature. The fixing property is improved and fixed images of high image quality free of ripple marks are obtained.

17 Claims, 6 Drawing Sheets

OTHER PUBLICATIONS

U.S. Appl. No. 11/082,218, filed Mar. 17, 2005, Tsueda et al.
U.S. Appl. No. 10/945,395, filed Sep. 21, 2004, Kinouchi et al.
U.S. Appl. No. 10/944,855, filed Sep. 21, 2004, Sone et al.
U.S. Appl. No. 10/944,707, filed Sep. 21, 2004, Sone et al.
U.S. Appl. No. 10/820,138, filed Apr. 8, 2004, Sone et al.
U.S. Appl. No. 10/805,514, filed Mar. 22, 2004, Kinouchi et al.
U.S. Appl. No. 10/805,305, filed Mar. 22, 2004, Sone et al.

* cited by examiner

FIXING DEVICE OF IMAGE FORMING APPARATUS WITH NON-CONTACT TEMPERATURE SENSOR

FIELD OF THE INVENTION

The present invention relates to a fixing device of an image forming apparatus loaded in the image forming apparatus such as a copier, a printer, or a facsimile for heating and fixing a toner image onto a sheet of paper.

DESCRIPTION OF THE BACKGROUND

As a fixing apparatus used in an image forming apparatus such as an electro-photographic copier or printer, there is a fixing apparatus for inserting a sheet of paper through a nipping section formed between a pair of rollers composed of a heat roller and a pressure roller or between similar belts and heating, pressurizing, and fixing a toner image. Such a heating type fixing apparatus, to maintain the heat roller at a fixed fixable temperature, detects the surface temperature of the heat roller by a temperature sensor and controls so as to turn a heating source ON or OFF according to detection results.

As a temperature sensor, in recent years, a temperature sensor of a non-contact type for detecting the temperature in no contact with the heat roller like an infrared temperature sensor has been used. The non-contact type temperature sensor does not damage the surface of the heat roller and the life span of the heat roller can be lengthened.

Such a non-contact type temperature sensor, to obtain high detection accuracy, must be positioned highly accurately to the heat roller and for example, in Japanese Patent Application Publication No. 2004-13024, a heat fixing apparatus in which a positioning pin of a temperature sensor is inserted into a positioning concavity formed in a fixing casing of a heat roller and the heat roller and temperature sensor are arranged at a fixed interval opposite to each other is disclosed.

Further, for example, in Japanese Patent Application 2002-294963, a fixing apparatus in which a temperature fuse as a temperature detection element is attached to a separation member arranged in the neighborhood of a heat roller and the temperature fuse is positioned to the heat roller is disclosed.

However, in these conventional temperature sensors, when the heat roller is exchanged or the temperature sensor is removed at the time of maintenance and is installed again, the interval between the heat roller and the temperature sensor is shifted due to the part accuracy and there is a fear of a reduction in the detection accuracy due to the temperature sensor. Therefore, in an apparatus in which a plurality of heating sources are dispersed and arranged in the axial direction and the heat rollers in the areas opposite to the respective heating sources are heated, there is a fear that the surface temperatures of the heat rollers in the axial direction become non-uniform. Therefore, the un-uniformity of the surface temperatures of the heat rollers appears in a fixed image and temperature ripple marks different in gloss are seen on the same image and the image quality is deteriorated.

On the other hand, in recent years, as a fixing apparatus of an induction heating method using an induction heating coil as a heating source, a fixing apparatus for installing a thinned metallic conductive layer having a small heat capacity on the surface of a heat roller to realize fast heating of the metallic conductive layer and realizing more energy conservation has been developed. In such a heat roller having a thinned metallic conductive layer with a small heat capacity, the temperature is changed greatly, so that when the detection accuracy of the temperature sensor is reduced, there is a fear that the precise surface temperature control of the heat roller may not be executed. Therefore, it is desired to improve the detection accuracy of the temperature sensor.

And, in a fixing apparatus for executing heating fixing, development of a fixing apparatus of an image forming apparatus in which a temperature sensor of a non-contact type for detecting the surface temperature of a heat roller is always positioned highly accurately to the heat roller, and the detection accuracy of the temperature sensor is improved, and the heat roller is accurately controlled in temperature, and the fixing property is improved, and a high image quality is obtained is desired.

SUMMARY OF THE INVENTION

An object of the embodiments of the present invention, in a fixing apparatus for executing heating fixing, regardless of exchange of a heat roller and a mounting and demounting operation of parts by maintenance, is to highly accurately position a temperature sensor of a non-contact type for detecting the surface temperature of the heat roller to the heat roller, highly accurately control the temperature of the heat roller, and obtain a high image quality by a satisfactory fixing property.

According to the embodiments of the present invention, there is provided a fixing apparatus of the image forming apparatus comprising: endless heating means; heating source means for heating the heating means; pressure means pressed to the heating means to form a nipping section for holding and conveying a medium to be fixed having a toner image in a predetermined direction together with the heating means; non-contact temperature sensor means for detecting a temperature of the heating means; and temperature sensor support means for attaching the temperature sensor means onto a support face installed in parallel with a rotation shaft of the heating means via a gap on a front of the heating means, positioning both sides of the support face on the basis of the rotation shaft, and keeping a gap between the temperature sensor means and the heating means constant.

DETAILED DESCRIPTION OF THE INVENTION

Figure 1:
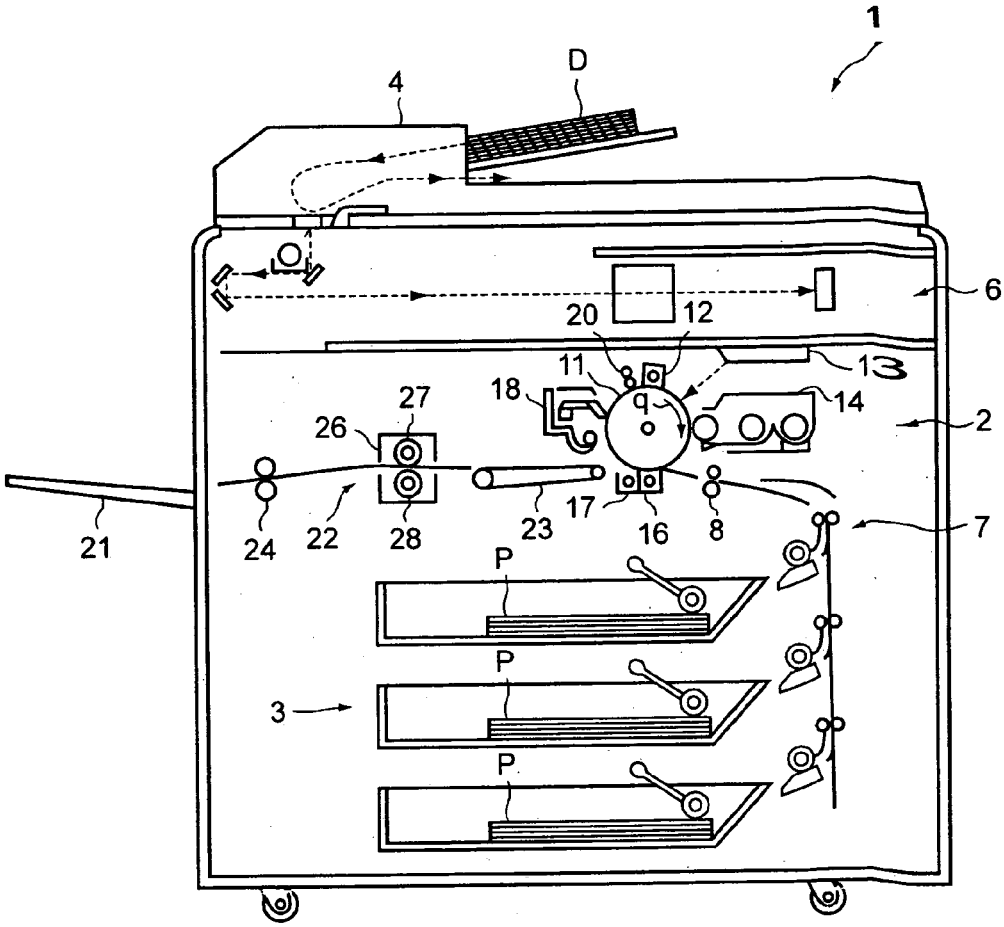
FIG. 1 is a schematic block diagram showing the image forming apparatus of the first embodiment of the present invention.

Hereinafter, the first embodiment of the present invention will be explained in detail with reference to the accompanying drawings. FIG. 1 is a schematic block diagram showing image forming apparatus 1 loading fixing apparatus 26 of the embodiment of the present invention. Image forming apparatus 1 has cassette mechanism 3 for feeding sheets of paper P, which are media to be fixed, to image forming unit 2 and has scanner section 6 for reading documents D fed by automatic document feeder 4 on the top thereof. On conveyor path 7 from cassette mechanism 3 to image forming unit 2, register rollers 8 are installed.

Image forming unit 2 includes, around photosensitive drum 11, charger 12 for uniformly charging photosensitive drum 11 sequentially according to the rotational direction of arrow q of photosensitive drum 11, laser exposure apparatus 13 for forming latent images on charged photosensitive drum 11 on the basis of image data from scanner 6, developing apparatus 14, transfer charger 16, separation charger 17, cleaner 18, and discharging LED 20. Image forming unit 2 forms toner images on photosensitive drum 11 by the known image forming process by the electro-photographic method and transfers them onto sheets of paper P.

On the downstream side of image forming unit 2 in the conveying direction of sheets of paper P, ejection paper conveyor path 22 for conveying sheets of paper P on which toner images are transferred toward paper ejection section 21 is installed. On ejection paper conveyor path 22, conveyor belt 23 for conveying sheets of paper P separated from photosensitive drum 11 to fixing apparatus 26 and paper ejection rollers 24 for ejecting sheets of paper P after passing fixing apparatus 26 to paper ejection section 21 are installed.

Figure 2:
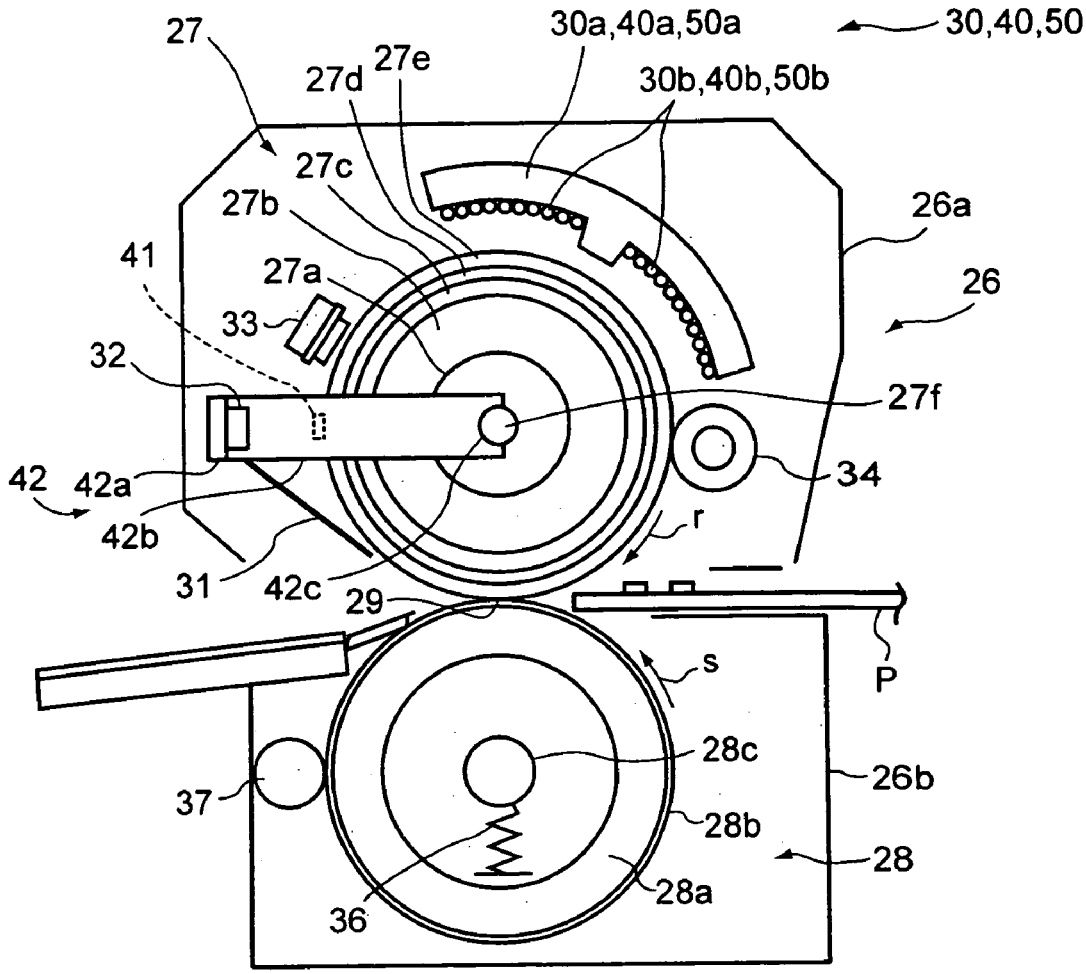
FIG. 2 is a schematic block diagram of the fixing apparatus of the first embodiment of the present invention viewed in the shaft direction of the heat roller.
Figure 3:
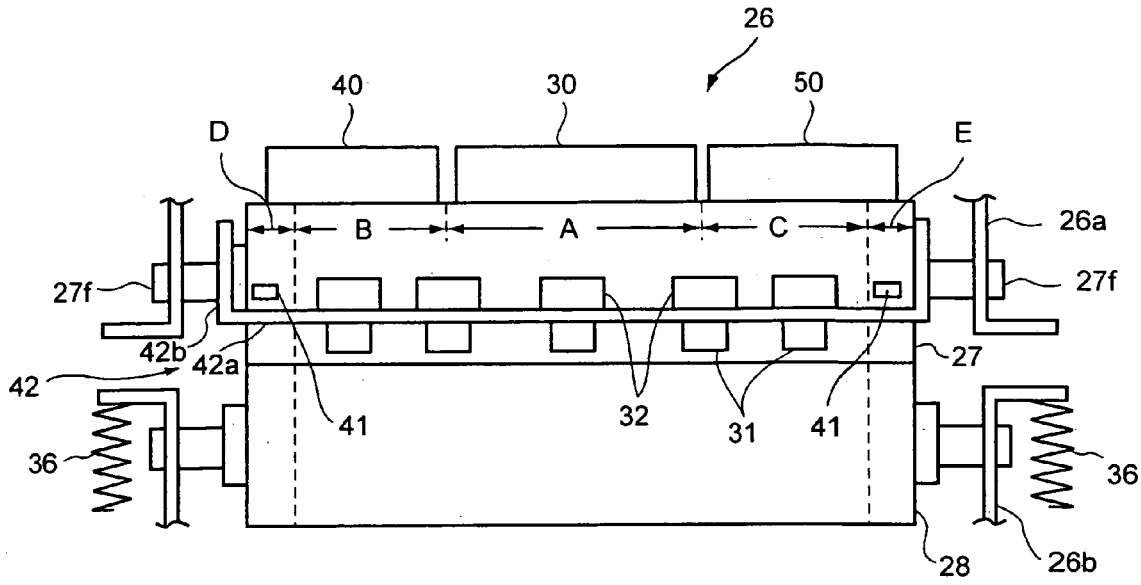
FIG. 3 is a schematic arrangement diagram of the fixing apparatus of the first embodiment of the present invention viewed in the direction perpendicular to the shaft of the heat roller.
Figure 4:
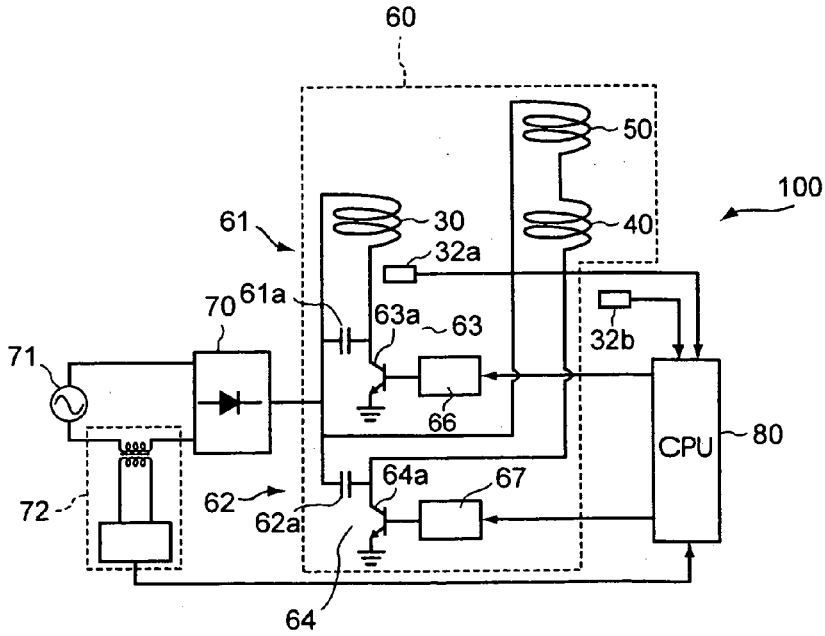
FIG. 4 is a schematic block diagram showing the heating control system of the heat roller of the first embodiment of the present invention.

Next, fixing apparatus 26 will be described. FIG. 2 is a schematic block diagram of fixing apparatus 26 viewed in the shaft direction, and FIG. 3 is a schematic arrangement view of fixing apparatus 26 viewed in the direction perpendicular to the shaft, and FIG. 4 is a block diagram showing control system 100 for heating heat roller 27 which is a heating means. Fixing apparatus 26 has heat roller 27 and pressure roller 28 which is a pressure means pressed to heat roller 27. Heat roller 27 is supported by upper frame 26*a* and pressure roller 28 is supported by lower frame 26*b*. Furthermore, fixing apparatus 26 has induction heating coils 30, 40, and 50 which are a heating source means for a 100-V power source for heating heat roller 27 via a gap of about 1.5 mm on the outer periphery of heat roller 27. Induction heating coils 30, 40, and 50 are in an almost coaxial shape with heat roller 27.

Furthermore, on the outer periphery of heat roller 27, in the rotational direction of arrow r of heat roller 27, separation pawl 31 for preventing sheets of paper P after fixing from wrapping, a plurality of infrared temperature sensors 32 of a thermopile type for detecting the surface temperature of heat roller 27 in non-contact, thermistor 41 which is a contact temperature sensor means for detecting the surface temperature at both ends of heat roller 27, thermostat 33 for detecting an abnormal surface temperature of heat roller 27 and interrupting heating, and cleaning roller 34 are installed. Induction heating coils 30, 40, and 50 and infrared temperature sensor 32 are arranged almost opposite to heat roller 27 across it.

In heat roller 27, around core bar 27*a*, expanded rubber 27*b* with a thickness of 5 mm, metallic conductive layer 27*c*, made of nickel (Ni), with a thickness of 40 μm, solid rubber layer 27*d* with a thickness of 200 μm, and release layer 27*e* with a thickness of 30 μm are sequentially formed in a diameter of 40 mm. Solid rubber layer 27*d* and release layer 27*e* form a protective layer.

Pressure roller 28 is composed of core bar 28*a* around which surface layer 28*b* such as silicone rubber or fluorine rubber is coated in a diameter of 40 mm. Pressure roller 28, since shaft 28*c* is pressed by pressure spring 36, is pressed to heat roller 27. By doing this, between heat roller 27 and pressure roller 28, nipping section 29 with a fixed width is formed. Further, around pressure roller 28, separation pawl 38 for separating sheets of paper P from pressure roller 28 in the rotational direction of arrow s and cleaning roller 37 are installed.

Induction heating coils 30, 40, and 50 are respectively supplied with a drive current, generate a magnetic field, generate an eddy current in metallic conductive layer 27*c* by this magnetic field, and heat metallic conductive layer 27*c*. Induction heating coils 30, 40, and 50 respectively heat areas A, B, and C of hear roller 27 in the longitudinal direction.

Induction heating coils 40 and 50 for heating areas B and C on both sides of heat roller 27 are connected in series and are driven under the sane control. According to a case of fixing large sheets of paper such as horizontal size A4 or A3 or a case of fixing vertical size A4 or other sheets of paper of small size, the driving ratio of induction heating coils 30, 40, and 50 is controlled, thus the temperature distribution of heat roller 27 in the longitudinal direction is made uniform.

Next, control system 100 for heating heat roller 27 will be described. As shown in the block diagram in FIG. 4, control system 100 for heating heat roller 27 has inverter circuit 60 for supplying a drive current to induction heating coils 30, 40, and 50, rectifier circuit 70 for supplying a DC supply voltage of 100 V to inverter circuit 60, and CPU 80 for controlling whole image forming apparatus 1, thereby inputting detection results of sheets of paper P by position sensor 9, and controlling inverter circuit 60 according to detection results of infrared temperature sensors 32 and thermistor 41. CPU 80, according to the detection results of infrared temperature sensors 32 and thermistor 41, may drive so as to output induction heating coil 30 or only either of induction heating coils 40 and 50 and may drive simultaneously induction heating coil 30 and both induction heating coils 40 and 50.

Rectifier circuit 70 is for 100 V and rectifies a current from commercial AC power source 71 to a direct current at 100 V and supplies it to inverter circuit 60. Between rectifier circuit 70 and commercial AC power source 71, power monitor 72 is connected, detects power supplied from commercial AC power source 71, and feeds it back to CPU 80.

Inverter circuit 60 uses a self excitation type semi-E class circuit. To induction heating coil 30 of inverter circuit 60, first capacitor 61*a* for resonance is connected in parallel to form first resonance circuit 61 and to induction heating coils 40 and 50 connected in series, second capacitor 62*a* for resonance is connected in parallel to form second resonance circuit 62. To first resonance circuit 61, first switching element 63*a* is connected in series to form first inverter circuit 63 and to second resonance circuit 62, second switching element 64*a* is connected in series to form second inverter circuit 64. Switching elements 63*a* and 64*a* use an IGBT usable at a high breakdown voltage and a large current. Switching elements 63*a* and 64*a* may be a MOSFET.

To the control terminals of switching elements 63*a* and 64*a*, IGBT driving circuits 66 and 67 for turning on switching elements 63*a* and 64*a* are respectively connected. CPU 80 controls the application timing of IGBT driving circuits 66 and 67. Inverter circuit 60 controls the ON time of switching elements 63*a* and 64*a* by CPU 80, thereby converts the frequency to 20 to 60 kHz. For induction heating coils 30, 40, and 50, the power value is controlled according to a frequency of 20 to 60 kHz of the drive current and by the power value of induction heating coils 30, 40, and 50, the heat value of metallic conductive layer 27*c* is varied, and heat roller 27 is controlled in temperature.

Figure 5:
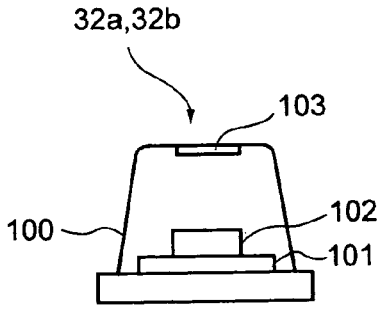
FIG. 5 is a schematic illustration showing the infrared temperature sensor of the first embodiment of the present invention.

Next, infrared temperature sensors 32, as shown in FIG. 5, have thermopile 102 composed of many thin-film thermocouples made of polysilicone and aluminum connected in series on silicone substrate 101 installed in housing 100. Housing 100 has silicone lens 103 and focuses infrared light from heat roller 27 to thermopile 102. Temperature changes of the temperature contact generated on thermopile 102 due to reception of infrared light are output to CPU 80 as start power of the thermocouple.

Such infrared temperature sensors 32 of a thermopile type are well known conventionally and are structured so as to make the heat capacity of the temperature contact of the thin-film thermocouple smaller, so that the temperature response is high. Infrared temperature sensors 32 of a thermopile type have a response speed faster by about 20 times of that of a conventional infrared temperature sensor. CPU 80, according to detection results of infrared temperature sensors 32 and thermistor 41, controls the frequency of a drive current of each of induction heating coils 30, 40, and 50 and controls the power value given to induction heating coils 30, 40, and 50.

Infrared temperature sensors 32 are fixed to support face 42*a* of support plate 42, which is a temperature sensor support means, by a screw or a pin. Support plate 42 may be made of a material not thermally deformed by heat convection from the heat roller such as glass filled mold resin, carbon, or ceramics. Further, separation pawl 31 is fixed to support face 42.

Both side arms 42*b* of support plate 42 are supported by upper frame 26*a* and notches 42*c* fit into roller shaft 27*f* of heat roller 27 are formed at the front ends thereof. Support plate 42 strikes the front ends of arms 42*b* against roller shaft 27*f*, fits notches 42*c* into roller shaft 27*f*, thereby always keeps the distance between heat roller 27 and support face 42*a* constant. As a result, infrared temperature sensors 32 supported by support face 42*a* are always positioned highly precisely to heat roller 27. Similarly, separation pawl 31 fixed to support face 42*a* is always positioned highly precisely to heat roller 27.

Infrared temperature sensors 32, on support face 42*a*, are installed in five positions such as positions equivalent to almost the central parts between induction heating coils 30, 40, and 50 and positions equivalent the intervals between induction heating coils 30, 40, and 50. Further, thermostats 41 are supported by upper frame 26*a*, make contact with non-image forming areas D and E at both ends of heat roller 27, and detect the temperature of heat roller 27 in the same phase as that of infrared temperature sensors 32.

Next, the operation of the invention will be described. Warming-up is started by turning the power source of image forming apparatus 1 ON. During warming-up, heat roller 27 is uniformly heated in all the area in the scanning direction which is the axial direction. The surface temperature of heat roller 27 is calculated from the output values (voltages) from infrared temperature sensors 32 and thermistors 41. Until heat roller 27 reaches the ready temperature detected by infrared temperature sensors 32 and thermistors 41, CPU 80 controls switching elements 63*a* and 64*a* of inverter circuit 60 and increases the output power value of induction heating coils 30, 40, and 50.

Heat roller 27, after reaching the ready temperature, according to detection results of infrared temperature sensors 32 and thermistors 41, controls the output power value of induction heating coils 30, 40, and 50 so as to keep the ready temperature. In the ready state, when the print operation is not instructed for a given period, fixing apparatus 26 enters the energy conservation mode and the output power value of induction heating coils 30, 40, and 50 is controlled. In the energy conservation mode, when the print operation is instructed next, the temperature of heat roller 27 can be returned to the ready temperature within the specified time. In the energy conservation mode, heat roller 27 may be heated partially without being uniformly heated in all the area in the scanning direction.

When the print operation is instructed next, immediately when heat roller 27 is in the ready state or when it is in the energy conservation mode, waiting for detecting the temperature of heat roller 72 by infrared temperature sensors 32 and thermistors 41 and arriving at the ready temperature, the image forming process starts. In image forming unit 2, photosensitive drum 11 rotating in the direction of arrow q is uniformly charged by charger 12 and is irradiated with a laser beam according to document information by laser exposure apparatus 13, thus an electrostatic latent image is formed. Next, the electrostatic latent image is developed by developing apparatus 14 and a toner image is formed on photosensitive drum 11.

The toner image on photosensitive drum 11 is transferred onto sheet of paper P by transfer charger 16. Next, sheet of paper P is separated from photosensitive drum 11, is conveyed to fixing apparatus 26, is rotated in the direction of arrow r, and is inserted through nipping section 29 between heat roller 27, for example, heated to the fixable temperature 160° C. and pressure roller 28 rotating in the direction of arrow s to heat, pressurize, and fix the toner image.

During fixing the toner image, in fixing apparatus 26, infrared temperature sensors 32 arranged on the downstream side of nipping section 29 and thermistors 41 detect the fallen surface temperature of heat roller 27 after passing nipping section 29 and finishing fixing. CPU 80, by detection results from infrared temperature sensors 32 and thermistors 41, according to the temperature difference between the surface temperature of heat roller 27 and the fixable temperature 160° C., controls switching elements 63*a* and 64*a* of inverter circuit 60. When CPU 80 supplies power to induction heating coils 30, 40, and 50 and excites induction heating coils 30, 40, and 50 in the area where heat roller 27 falls in temperature, an eddy current is generated in metallic conductive layer 27*c* and heat roller 27 is heated.

By doing this, heat roller 27, before reaching next nipping section 29 after passing induction heating coils 30, 40, and 50, is heated and returned to the fixable temperature 160° C. in all the area in the scanning direction. Therefore, the surface temperature of heat roller 27 in nipping section 29 is always heated to the fixable temperature 160° C. in all the area in the scanning direction and a toner image formed on sheet of paper P is uniformly fixed in both scanning direction and conveying direction without generating temperature ripple marks.

Further, the magnetic flux generated by excitation of induction heating coils 30, 40, and 50 generally affects adversely not only metallic conductive layer 27*c* but also the neighboring conductive materials and there is a fear that infrared temperature sensors 32 themselves may be heated or cause noise. However, in this embodiment, infrared temperature sensors 32 are arranged at the opposite positions away from induction heating coils 30, 40, and 50 across heat roller 27. Therefore, infrared temperature sensors 32 are not adversely affected by the magnetic flux of induction heating coils 30, 40, and 50 and detect highly accurately the temperature at the detection position on heat roller 27.

Further, during fixing in this way, when the temperature difference between the detection temperature by infrared temperature sensors 32 and the fixable temperature 160° C. varies with changes in the, size, thickness, and material of sheets of paper P or environment, CPU 80 controls inverter circuit 60 according to the temperature difference, changes the output power value of induction heating coils 30, 40, and 50, and always controls the surface temperature of heat roller 27 in nipping section 29 to the fixable temperature 160° C.

After ending of the fixing, CPU 80, according to the detection temperature by infrared temperature sensors 32 and thermistors 41, maintains and controls heat roller 27 to the ready temperature under the ON-OFF control of inverter circuit 60 and stands by for the next fixing operation. When the print operation is not instructed for a given period, CPU 80 sets the energy conservation mode and according to the detection temperature of infrared temperature sensors 32 and thermistors 41, controls the temperature of heat roller 27.

During this period, when heat roller 27 is to be exchanged or fixing apparatus 26 is to be maintained, both side arms 42*b* of support plate 42 are pulled out, and notches 42*c* at the front ends are removed from roller shaft 27*f*, and infrared temperature sensors 32 are removed from fixing apparatus 26. New heat roller 27 is attached to upper frame 26*a*, and then the front ends of arms 42*b* are struck against roller shaft 27*f*, and notches 42*c* are fit into roller shaft 27*f*, and support plate 42 is attached to new roller shaft 27*f*.

At this time, depending on the part accuracy, the attaching position of new heat roller 27 to upper frame 26*a* may be shifted. However, support plate 42 is positioned to roller shaft 27*f* of heat roller 27, so that even if the exchange operation of heat roller 27 or the maintenance operation thereof is performed, the distance between heat roller 27 and infrared temperature sensors 32 supported by support face 42*a* is always kept constant. As a result, the detection accuracy of the surface temperature of heat roller 27 by infrared temperature sensors 32 is kept with high accuracy and fixing apparatus 26, similarly to before exchange of heat roller 27 or before maintenance thereof, can perform homogeneous fixing free of temperature ripple marks.

According to this embodiment, support plate 42 for fixing and arranging infrared temperature sensors 32 strikes arms 42*b* against roller shaft 27*f* of heat roller 27, so that regardless of the part accuracy, arms 42*b* are always positioned highly accurately to heat roller 27 on the basis of roller shaft 27*f*. By doing this, even after heat roller 27 is exchanged or maintained, when arms 42*b* are only struck against roller shaft 27*f*, infrared temperature sensors 32 are always positioned highly accurately to heat roller 27. Therefore, infrared temperature sensors 32 always can detect highly accurately the surface temperature of heat roller 27 and can highly accurately execute temperature control of heat roller 27 executed according to detection results of infrared temperature sensors 32 in all the area in the scanning direction. As a result, a toner image can be fixed at a fixed temperature in both scanning direction and conveying direction, and no ripple marks are caused on a fixed image, and the image quality is improved by a satisfactory fixing property.

Further, according to this embodiment, induction heating coils 30, 40, and 50 and infrared temperature sensors 32 are arranged almost opposite to each other across heat roller 27. Therefore, the magnetic flux generated from induction heating coils 30, 40, and 50 do not adversely affect infrared temperature sensors 32 and infrared temperature sensors 32 can detect highly accurately the temperature of heat roller 27.

Next, the second embodiment of the present invention will be explained. In the second embodiment, the heat roller in the first embodiment is changed to a fixing belt and the other is the same as that of the first embodiment. Therefore, in the second embodiment, to the same components as those of the first embodiment, the same numerals are assigned and the detailed explanation will be omitted.

Figure 6:
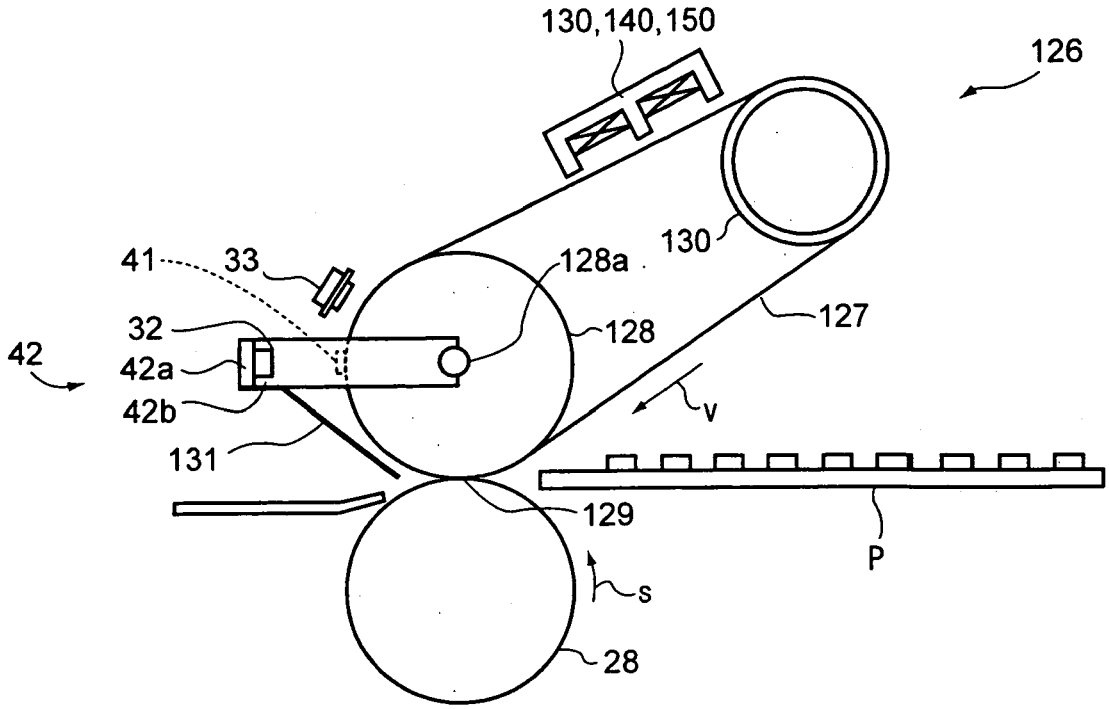
FIG. 6 is a schematic block diagram showing the fixing apparatus of the second embodiment of the present invention.

Fixing apparatus 126 shown in FIG. 6 in the second embodiment has fixing belt 127 with a peripheral length of 70×Π (mm), which is an endless heating member, stretched between first and second backup rollers 128 and 130. At the position of first backup roller 128, pressure roller 28 is pressed to fixing belt 127 and between fixing belt 127 and pressure roller 28, nipping section 129 with a fixed width is formed. In the rotational direction of arrow v of fixing belt 127, on the downstream side of nipping section 129, separation pawl 131 for preventing sheets of paper P after fixing from wrapping, infrared temperature sensors 32 of a thermopile type for detecting the surface temperature of heat roller 27 in non-contact and thermistors 41, and thermostat 33 for detecting an abnormal surface temperature of fixing belt 127 and interrupting heating are installed.

On the opposite side of infrared temperature sensors 32 across fixing belt 127, induction heating coils 130, 140, and 150 which are induced current generation means for a power source of 100 V for heating fixing belt 127 are installed via fixing belt 127 and a gap of about 1.5 mm.

Figure 7:
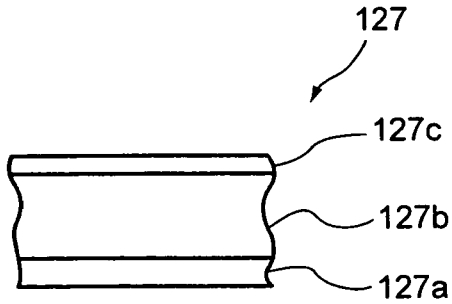
FIG. 7 is a schematic illustration showing the layer constitution of the fixing belt of the second embodiment of the present invention.

Fixing belt 127, as shown in FIG. 7, is a three-layer belt structured so that the surface of nickel (Ni) substrate 127*a* with a thickness of 40 μm is covered with elastic silicone rubber 127*b* in a thickness of 300 μm and moreover, to give a release property, is covered with release layer 127*c* made of fluorine plastics in a thickness of 30 μm. The base material of the fixing belt, if it is conductive, may be SUS or polyimide coated with a metallic layer.

Arms 42*b* of support plate 42 fixing infrared temperature sensors 32 strike against roller shaft 128*a* of first backup roller 128, fit notches 42*c* into roller shaft 128*a*, thereby always keep the distance between fixing belt 127 and support face 42*a*, that is, the distance between fixing belt 127 and infrared temperature sensors 32 constant. Therefore, infrared temperature sensors 32 always detect highly accurately the surface temperature of fixing belt 127, accurately control the temperature of fixing belt 127, and execute homogeneous fixing free of temperature ripple marks.

As a result, similarly to the first embodiment, even if arms 42*b* of support plate 42 are pulled out once from roller shaft 128*a* for maintenance and then are fit again into roller shaft 128*a*, regardless of the part accuracy, the distance between fixing belt 127 and infrared temperature sensors 32 supported by support face 42*a* can be always kept constant. As a result, the detection accuracy of the surface temperature of fixing belt 127 by infrared temperature sensors 32 is kept highly accurately and fixing apparatus 126, similarly to before exchange of heat roller 127 or before maintenance thereof, can perform homogeneous fixing free of temperature ripple marks.

According to this embodiment, support plate 42 for fixing infrared temperature sensors 32 are always positioned highly accurately to fixing belt 127 on the basis of roller shaft 128*a* of backup roller 128, so that infrared temperature sensors 32 are always positioned highly accurately to fixing belt 127. Therefore, infrared temperature sensors 32 always can detect highly accurately the surface temperature of heat roller 127 and can highly accurately execute temperature control of fixing roller 127 in all the area in the scanning direction. As a result, a toner image can be fixed at a fixed temperature in both scanning direction and conveying direction, and no ripple marks are caused on a fixed image, and the image quality is improved by a satisfactory fixing property.

Further, induction heating coils 130, 140, and 150 and infrared temperature sensors 32 are arranged almost opposite to each other across fixing belt 127, so that the magnetic flux of induction heating coils 130, 140, and 150 do not adversely affect infrared temperature sensors 32 and infrared temperature sensors 32 can detect highly accurately the temperature on fixing belt 127.

Next, the third embodiment of the present invention will be explained. The third embodiment is different from the first embodiment in that during perpendicularly conveying a sheet of paper taken out from the cassette mechanism, a toner image is fixed and the other is the same as that of the first embodiment. Therefore, in the third embodiment, to the same components as those of the first embodiment, the same numerals are assigned and the detailed explanation will be omitted.

Figure 8:
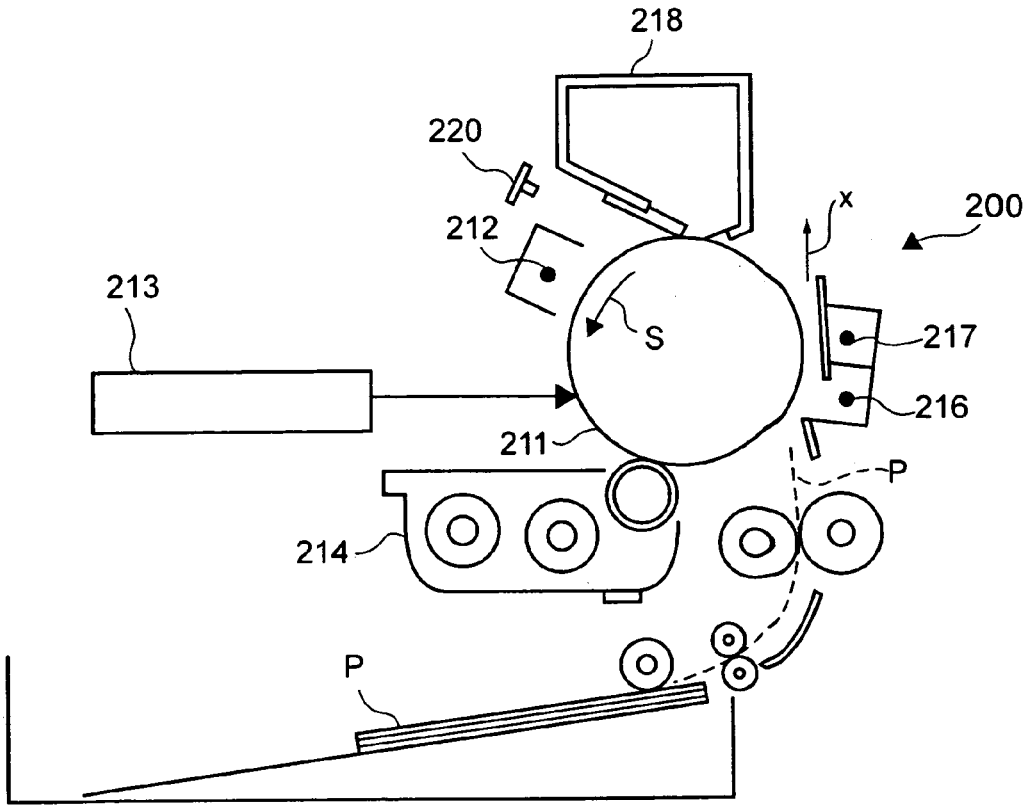
FIG. 8 is a schematic block diagram showing the image forming unit of the image forming apparatus of the third embodiment of the present invention.

Image forming unit 200 of the image forming apparatus of this embodiment, as shown in FIG. 8, around photosensitive drum 211 rotating in the direction of arrow w, includes charger 212, laser exposure apparatus 213, developing apparatus 214, transfer charger 216, separation charger 217, cleaner 218, and discharging LED 220. Image forming unit 200 forms toner images on photosensitive drum 211 by the known image forming process by the electro-photographic method and transfers them onto sheets of paper P.

Figure 9:
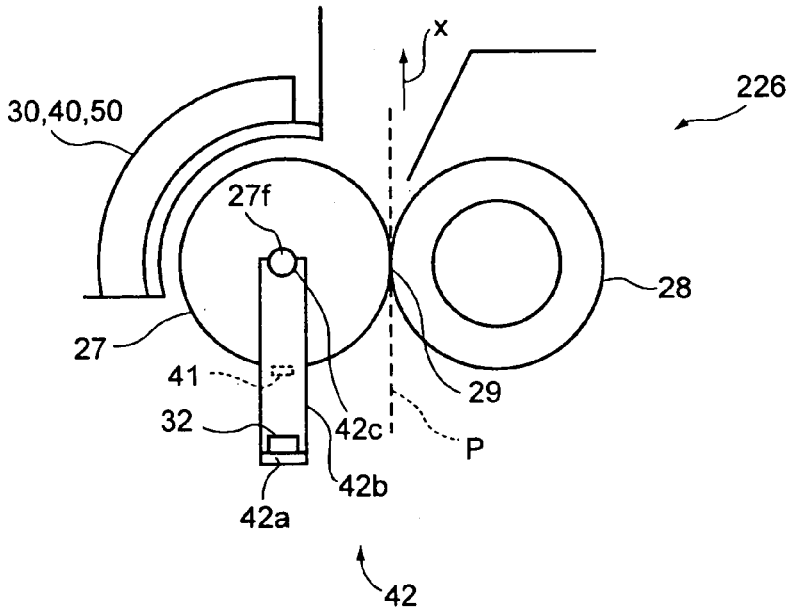
FIG. 9 is a schematic block diagram showing the fixing apparatus of the third embodiment of the present invention.

On the downstream side of image forming unit 200 in the conveying direction of sheets of paper P which is the direction of arrow x, fixing apparatus 226 shown in FIG. 9 is arranged. Fixing apparatus 226 vertically conveys sheet of paper P having a transferred toner image and heats, pressurizes, and fixes the toner image in nipping section 29 with a fixed width between heat roller 27 and pressure roller 28. Induction heating coils 30, 40, and 50 and infrared temperature sensors 32 fixed to support face 42*a* of support plate 42 are arranged almost opposite to each other across heat roller 27. Furthermore, induction heating coils 30, 40, and 50 are arranged above nipping section 29 and infrared temperature sensors 32 are arranged under nipping section 29.

According to this embodiment, infrared temperature sensors 32 are always positioned highly accurately to heat roller 27 via support plate 42. Therefore, infrared temperature sensors 32 always can detect highly accurately the surface temperature of heat roller 27 and can highly accurately execute temperature control of heat roller 27 executed according to detection results of infrared temperature sensors 32 in all the area in the scanning direction. As a result, a toner image can be fixed at a fixed temperature in both scanning direction and conveying direction, and no ripple marks are caused on a fixed image, and the image quality is improved by a satisfactory fixing property.

Further, according to this embodiment, induction heating coils 30, 40, and 50 and infrared temperature sensors 32 are arranged almost opposite to each other across heat roller 27, and moreover, via nipping section 29, induction heating coils 30, 40, and 50 are arranged above it and infrared temperature sensors are arranged below it. Therefore, infrared temperature sensors 32 are not adversely affected by the magnetic flux generated from induction heating coils 30, 40, and 50, furthermore, are not adversely affected by the heat of heat roller 27 heated by induction heating coils 30, 40, and 50, thus can detect highly accurately the temperature of heat roller 27.

Next, the fourth embodiment of the present invention will be explained. The fourth embodiment is different from the first embodiment in that infrared temperature sensors 32 are arranged outside upper frame 26*a* of fixing apparatus 26 and the other is the same as that of the third embodiment. Therefore, in the fourth embodiment, to the same components as those of the third embodiment, the same numerals are assigned and the detailed explanation will be omitted.

Figure 10:
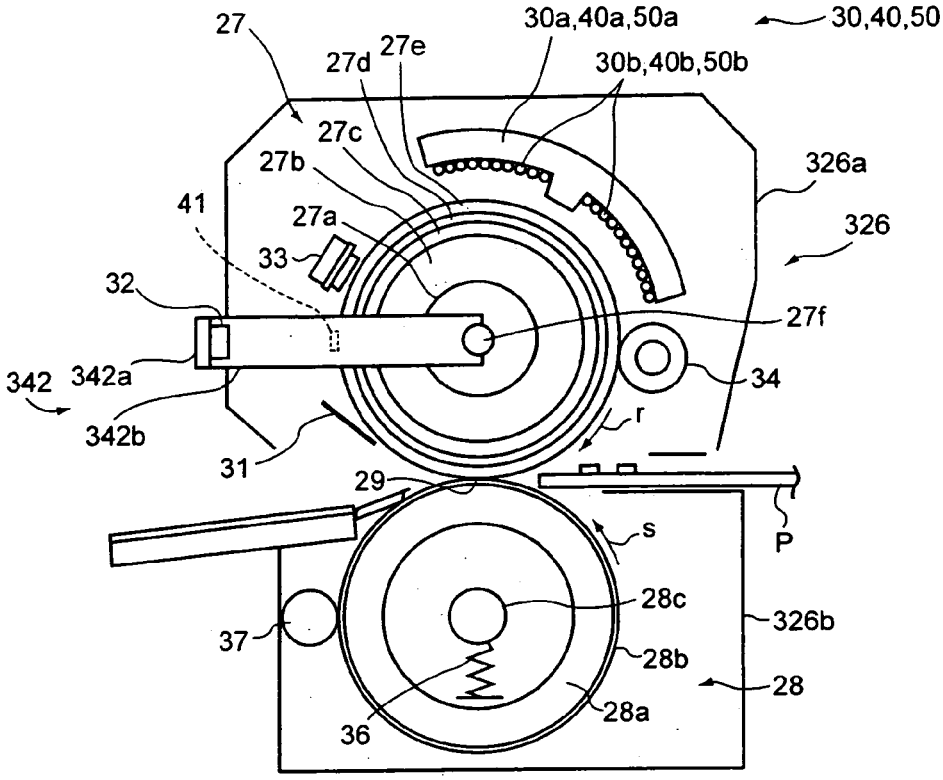
FIG. 10 is a schematic block diagram of the fixing apparatus of the fourth embodiment of the present invention viewed in the shaft direction of the heat roller.
Figure 11:
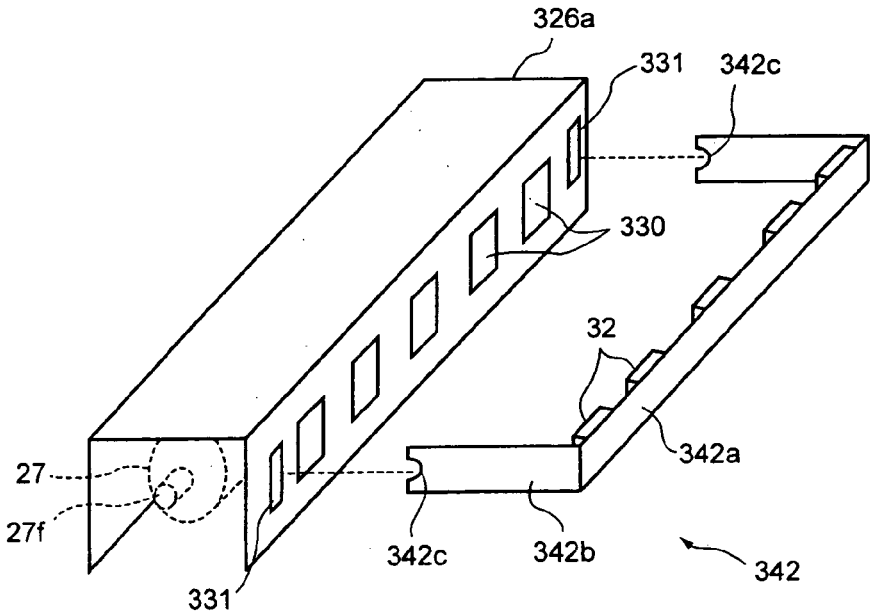
FIG. 11 is a schematic perspective view showing the upper frame and support frame of the fourth embodiment of the present invention.

FIG. 10 is a schematic block diagram of fixing apparatus 326 of this embodiment viewed in the shaft direction and FIG. 11 is a schematic perspective view showing upper frame 326*a* and support frame 342 of this embodiment. In this embodiment, on the side of upper frame 326*a* which is a shielding means of fixing apparatus 326, detection window 330 for receiving infrared light from heat roller 27 is formed. Infrared temperature sensors 32 strike against roller shaft 27*f* of heat roller 27 from the outside of upper frame 326*a* and are fixed to support frame 342 which is a temperature sensor support means positioned on the basis of roller shaft 27*f*. On upper frame 326*a*, slit 331 inserted through arms 342*b* of support frame 342 is formed.

At the front end of arm 342*a*, notch 342*c* fit into roller shaft 27*f* of heat roller 27 is formed. Support frame 342 inserts arm 342*b* through slit 331 and upper frame 326, strikes the front end thereof against roller shaft 27*f*, fits notch 342*c* into roller shaft 27*f*, thereby always positions highly accurately the distance between heat roller 27 and infrared temperature sensors 32.

Further, infrared temperature sensors 32 are arranged outside frame 326*a*, so that the magnetic flux of induction heating coils 30, 40, and 50 is shielded surely by upper frame 326*a*, and infrared temperature sensors 32 are not adversely affected at all by the flux of induction heating coils 30, 40, and 50 and detect highly accurately the temperature at the detection position on heat roller 27.

According to this embodiment, infrared temperature sensors 32 are supported by support plate frame 342 and are always positioned highly accurately to heat roller 27. Therefore, infrared temperature sensors 32 always can detect highly accurately the surface temperature of heat roller 27 and can highly accurately execute temperature control of heat roller 27 executed according to detection results of infrared temperature sensors 32 in all the area in the scanning direction. As a result, a toner image can be fixed at a fixed temperature in both scanning direction and conveying direction, and no ripple marks are caused on a fixed image, and the image quality is improved by a satisfactory fixing property.

Further, according to this embodiment, upper frame 326*a* is arranged between induction heating coils 30, 40, and 50 and infrared temperature sensors 32. Therefore, infrared temperature sensors 32 are surely prevented from effect of the magnetic flux of induction heating coils and infrared temperature sensors 32 can detect highly accurately the temperature of heat roller 27.

Further, the present invention is not limited to the aforementioned embodiments and within the scope of the present invention, can be modified variously and for example, the temperature sensor kind and response time are not restricted. Further, the temperature sensor support means, if it can surely position temperature sensors to the heating means, is not restricted on the shape thereof and for example, the front end of the arm may be attached to a ring fixed to the roller shaft of the heating means. Further, the heating source is not limited to the induction heating coils, and a heater may be used for heating, and the induction heating coils may be installed inside the heating means.

As described above in detail, according to the present invention, regardless of the part accuracy, the interval between the non-contact temperature sensors and the heating member can be always positioned highly accurately. Therefore, the temperature of the heating member can be controlled highly accurately in all the area in the scanning direction, and a toner image can be always fixed at a fixed temperature in both scanning direction and conveying direction, and due to the improved fixing property, no ripple marks are caused on fixed images, and fixed images of high image quality are obtained. Further, the heating source is arranged so as to prevent the temperature sensors from being adversely affected, so that the detection accuracy of the temperature sensors can be kept.

What is claimed is:

1. A fixing apparatus of an image forming apparatus comprising:

endless heating means;

heating source means for heating the heating means;

pressure means pressed to the heating means to form a nipping section for holding and conveying a medium to be fixed having a toner image in a predetermined direction together with the heating means;

non-contact temperature sensor means for detecting a temperature of the heating means; and temperature sensor support means for attaching the temperature sensor means onto a support face installed in parallel with a rotation shaft of the heating means via a gap on a front of the heating means, positioning both sides of the support face on the basis of the rotation shaft, and keeping a gap between the temperature sensor means and the heating means constant, wherein the heating means is heating roller means and the temperature sensor support means abuts the both sides on a roller shaft of the heating roller means and keeps the gap between the temperature sensor means and the heating means constant.

2. The fixing apparatus of an image forming apparatus according to claim 1, wherein the temperature sensor means and the heating source means are sequentially arranged on a downstream side of the nipping section in a rotational direction of the heating means.

3. The fixing apparatus of an image forming apparatus according to claim 1, wherein the temperature sensor means is non-contact infrared temperature sensor means of a thermopile type.

4. The fixing apparatus of an image forming apparatus according to claim 1, wherein the heating means has a conductive heat generation layer and the heating source means is induced current generation means for generating an induced current in the heat generation layer.

5. The fixing apparatus of an image forming apparatus according to claim 1, wherein a plurality of the heating source means are installed in a direction of the rotation shaft and at least one of each of the temperature sensor means is installed in a position corresponding to each of the plurality of heating source means.

6. The fixing apparatus of an image forming apparatus according to claim 1, further comprising contact temperature sensor means in contact with the heating means for detecting a temperature of the heating means on both sides of a temperature detection position of the heating means by the temperature sensor means.

7. The fixing apparatus of an image forming apparatus according to claim 1, wherein the temperature sensor support means supports separation means for separating the medium to be fixed from the heating means.

8. The fixing apparatus of an image forming apparatus according to claim 1 further comprising shielding means wherein a detection window is formed in correspondence with a detection position of the temperature sensor means in the gap between the heating means and the support face.

9. A fixing apparatus of an image forming apparatus comprising:

endless heating means;

heating source means for heating the heating means;

pressure means pressed to the heating means to form a nipping section for holding and conveying a medium to be fixed having a toner image in a predetermined direction together with the heating means;

non-contact temperature sensor means for detecting a temperature of the heating means; and temperature sensor support means for attaching the temperature sensor means onto a support face installed in parallel with a rotation shaft of the heating means via a gap on a front of the heating means, positioning both sides of the support face on the basis of the rotation shaft, and keeping a gap between the temperature sensor means and the heating means constant, wherein the heating means is fixing belt means stretched between a plurality of backup rollers and the temperature sensor support means abuts the both sides on a shaft of the backup rollers and keeps the gap between the temperature sensor means and the heating means constant.

10. A fixing apparatus of an image forming apparatus comprising:

an endless heating member;

a heating source member installed in the neighborhood of the heating member;

a pressure member pressed to the heating member to form a nipping section to hold and convey a medium to be fixed having a toner image in a predetermined direction together with the heating member;

a non-contact temperature sensor member arranged opposite to the heating source member across the heating member to detect a temperature of the heating member; and a temperature sensor support member to attach the temperature sensor member onto a support face installed in parallel with a rotation shaft of the heating member via a gap on a front of the heating member, position both sides of the support face on the basis of the rotation shaft, and keep a gap between the temperature sensor member and the heating member constant, wherein the heating member is a heating roller and the temperature sensor support member abuts the both sides on a roller shaft of the heating roller and keeps the gap between the temperature sensor member and the heating member constant.

11. The fixing apparatus of an image forming apparatus according to claim 10, wherein the temperature sensor member is a non-contact infrared temperature sensor of a thermopile type.

12. The fixing apparatus of an image forming apparatus according to claim 10, wherein the heating member has a conductive heat generation layer and the heating source member is an induction heating coil to generate an induced current in the heat generation layer.

13. The fixing apparatus of an image forming apparatus according to claim 10, wherein a plurality of the heating source members are installed in a direction of the rotation shaft and at least one of each of the temperature sensor members is installed in a position corresponding to each of the plurality of heating source members.

14. The fixing apparatus of an image forming apparatus according to claim 10 further comprising a contact temperature sensor in contact with the heating member for detecting a temperature of the heating member on both sides of a temperature detection position of the heating member by the temperature sensor member.

15. The fixing apparatus of an image forming apparatus according to claim 10, wherein the temperature sensor support member supports a separation pawl for separating the medium to be fixed from the heating member.

16. The fixing apparatus of an image forming apparatus according to claim 10 further comprising a shielding member wherein a detection window is formed in correspondence with a detection position of the temperature sensor member in the gap between the heating member and the support face.

17. A fixing apparatus of an image forming apparatus comprising:

an endless heating member;

a heating source member installed in the neighborhood of the heating member;

a pressure member pressed to the heating member to form a nipping section to hold and convey a medium to be fixed having a toner image in a predetermined direction together with the heating member;

a non-contact temperature sensor member arranged opposite to the heating source member across the heating member to detect a temperature of the heating member; and a temperature sensor support member to attach the temperature sensor member onto a support face installed in parallel with a rotation shaft of the heating member via gap on a front of the heating member, position both sides of the support face on the basis of the rotation shaft, and keep a gap between the temperature sensor member and the heating member constant, wherein the heating member is a fixing belt stretched between a plurality of backup rollers and the temperature sensor support member abuts the both sides on a shaft of the backup rollers and keeps the gap between the temperature sensor member and the heating member constant.

* * * * *